US007004790B2

(12) United States Patent
Martin et al.

(10) Patent No.: US 7,004,790 B2
(45) Date of Patent: Feb. 28, 2006

(54) ELECTRICAL CONNECTOR HAVING IMPROVED TERMINAL RETENTION

(75) Inventors: Galen M. Martin, Camp Hill, PA (US); Matthew F. Foriska, Harrisburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/856,298

(22) Filed: May 28, 2004

(65) Prior Publication Data

US 2005/0266738 A1 Dec. 1, 2005

(51) Int. Cl.
*H01R 13/40* (2006.01)

(52) U.S. Cl. ..... 439/595

(58) Field of Classification Search ..... 439/595, 439/752, 598, 750

See application file for complete search history.

(56) References Cited

U.S. PATENT DOCUMENTS 5,004,436 A * 4/1991 Aoyama ..... 439/752

* cited by examiner

*Primary Examiner*—Phuong Dinh

(57) ABSTRACT

An electrical connector is shown having a housing and a secondary lock member which is movable between a terminal insertion position and a terminal lock position. A primary locking latch of the connector housing is defined by an arch-shaped member having upstanding posts which flank the terminal receiving passageway and have a depending cantilever latch arm extending forwardly therefrom and extending into the terminal passageway. The latch is resiliently movable in multiple directions during the terminal insertion, as the posts can be movable in a longitudinal direction while at the same time the latch arm can be resiliently moved in a cantilevered beam fashion depending from the arch member. The slidable secondary lock is moved into a position behind the arch member, and secondarily locks the terminal in place, while at the same time provides a backup to the arch members of the locking latch.

24 Claims, 10 Drawing Sheets

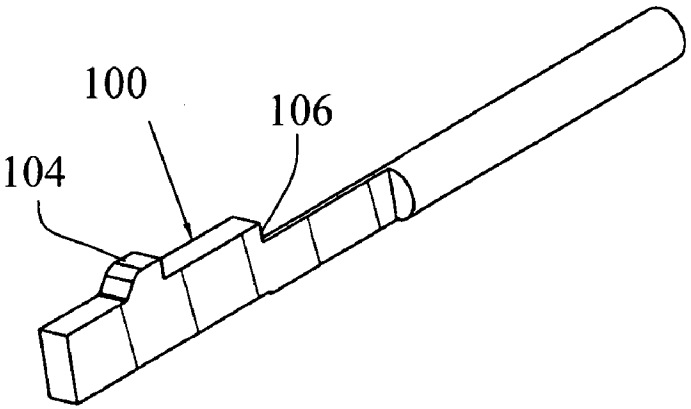
FIG. 10
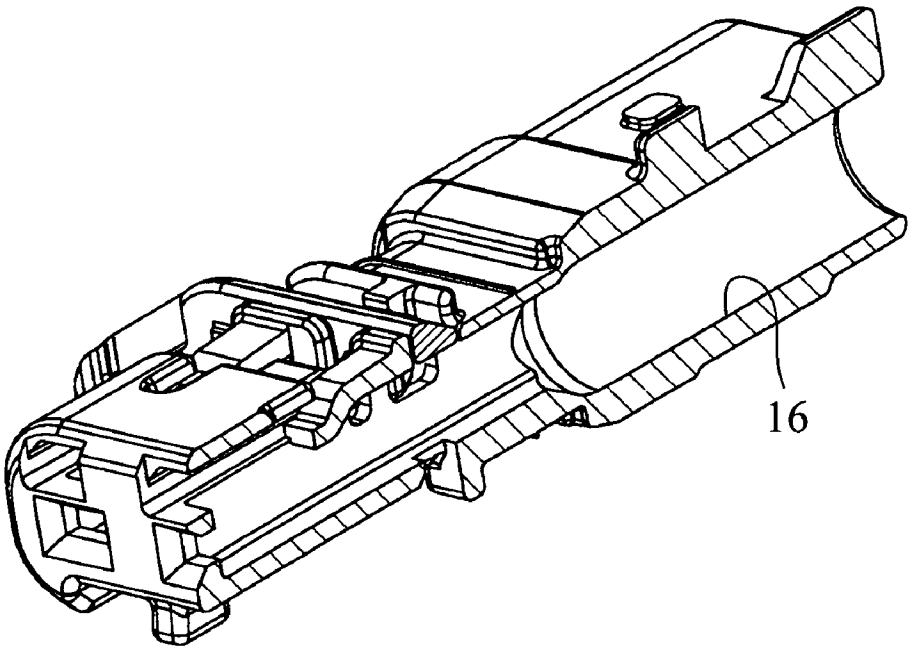

ELECTRICAL CONNECTOR HAVING IMPROVED TERMINAL RETENTION

BACKGROUND OF THE INVENTION

The invention is directed to an improved retention system, and in particular to an improved locking latch for retaining electrical terminals within connector housings, and a secondary locking mechanism therefor.

There are many applications for electrical connectors where the interconnection is subject to adverse conditions, such as high vibrations, inclement weather requiring sealing, and the like. Such is the case in automotive electrical systems. Furthermore, it is desirable to minimize the size of the electrical connectors and their corresponding contacts to provide for a high density of electrical connections. As the size of the electrical connector is reduced, the challenges associated with the connector design are increased. For example, the contacts must still be retained within the housings, yet the magnitude of the mechanical forces that can be exerted to retain the contacts within their corresponding housings is reduced. As a result, in high vibration environments, the magnitude of the mechanical force may not be sufficient to retain electrical contacts in their corresponding housings.

In order to assure the primary retention of a socket-type electrical contact as described above, it is known to include a locking latch or lance, which is integral with the housing. This locking latch normally depends from a housing side wall, and depends into the terminal passageway. The latches need to be resilient because the terminals are inserted into the passageways, where the latches are resiliently biased to allow insertion, and then snap back into a retentive position. When the connector housing are reduced in size, all of the components also must be reduced, and in the case of a reduction in length, the length of the locking latches must be proportionately reduced in length. The problem associated with reducing the length of the locking latch is that the latches are less resilient and in some cases brittle, and can either snap off or take on a plastically deformed set.

One interconnection commonly used in high vibration environments is between a pin- or tab-type terminal and a socket-type electrical contact which is retained in a connector housing that is adapted to mate with the component containing the tab-type terminal. A known socket-type electrical contact includes two opposing contact arms that are constricted to engage the tab-type terminal therebetween and exert a normal force against the tab. The contact arms are interconnected to a central body that commonly form into a box like member. A transition section extends from the central body opposite the contact arms to a conductor engaging portion that may be adapted to be crimpably attached to a conductor, such as an insulated wire.

It is also known to provide a secondary locking feature that mechanically locks the electrical contact to the housing within which it is disposed. The secondary locking member is typically a non-conductive component which may, or may not, be integrally formed as part of the connector housing and includes a bearing surface, or an engaging surface, that blocks the contact to prevent displacement thereof. The contact must contain a complementary bearing surface that is engageable or abuttable by the secondary locking member so that movement of the contact may be opposed. It is known to provide the secondary locking between the bearing surface of the secondary lock with an edge of the central body of the terminal to be locked.

Thus, the problems associated with the reduction in size of the connectors is that the housing become so small that no resiliency exists in the locking latch, and there is no provision, or no space for provision of, a secondary lock member for secondarily locking the terminals in place.

The objects of the invention are therefore to provide solutions to one or more of the shortcomings mentioned above.

SUMMARY OF THE INVENTION

The objects have been accomplished by providing an electrical connector comprised of a housing having a terminal receiving passageway therethrough, the passageway including an integrated latch member. The latch member including at least one post member upstanding from a periphery of the passageway, and a terminal retaining latch extending from the post, and extending in a resilient manner therefrom.

The integrated latch member may include two upstanding posts from the passageway in an arch-shaped manner, with the terminal retaining latch extending forwardly therefrom. The housing may include an opening through the passageway over the terminal retaining latch for access thereto. The connector may also further comprise an overstress tab, adjacent the opening, and extending over the top of the terminal retaining latch.

The connector may comprise a plurality of passageways, and the posts are defined by a slot extending behind the posts. A secondary lock member may be slidably received in the slot, the secondary lock member having openings and lock members, and the secondary latch being movable from a first position where the openings are aligned with the passageways and allows a terminal to be inserted therein, to a second position where the lock members of the secondary lock move to a position behind a contact in the passageway to secondarily lock the terminal in place. The secondary lock member may be profiled to closely approximate the slot and profiled to back up the post.

In another aspect of the invention, an electrical connector is comprised of a housing having a terminal receiving passageway therethrough, and an integrated latch member resiliently deformable in a plurality of directions.

The latch may be profiled in the form of an arch flanking the passageway and having a latch arm extending integrally therefrom and extending into the passageway. The arch may be partially defined by a slot extending behind, and transversely of, the passageways. The latch arm may extend forwardly from the arch. The electrical connector may be connected to the housing only by the arch.

The arch may be resiliently movable in the longitudinal direction, and the latch arm depends from said arch member in a resiliently cantilevered manner. The housing may include an opening through the passageway over the latch arm for access thereto. The connector housing may further comprise an overstress tab, adjacent the opening, and extend over the top of the latch arm. The connector housing may also comprise a plurality of passageways.

A secondary lock member may also be provided, slidably received in the slot, where the secondary lock member has openings and lock members. The secondary latch is movable from a first position where the openings are aligned with the passageways and allows a terminal to be inserted therein, to a second position where the lock members of the secondary lock move to a position behind a portion of a contact in the passageway to secondarily lock the terminal in place. The secondary lock member may also be profiled to closely approximate the slot and backs up the arch.

In yet another embodiment of the invention, an electrical connector is comprised of a housing having a terminal receiving passageway therethrough, the passageway including an integrated latch member having a portion connected to the housing and movably longitudinally thereto and a latch arm extending therefrom, and a slot extending rearwardly of the integrated latch portions, and having a slidable member receivable in the slot to back up the integrated latch members.

The integrated latch member may include two upstanding posts extending upwardly from the passageway in an arch-shaped manner, with the latch member extending integrally and forwardly therefrom. The housing may include an opening through the passageway over the integrated latch member for access thereto. The connector may further comprise an overstress tab, adjacent the opening, and extending over the top of the latch member.

Finally, the slidable member is defined as a secondary lock member slidably received in the slot, the secondary lock member having openings and lock members. The secondary latch may be movable from a first position where the openings are aligned with the passageways and allows a terminal to be inserted therein, to a second position where the lock members of the secondary lock move to a position behind a contact in the passageway to secondarily lock the terminal in place.

BRIEF DESCRIPTION OF THE DRAWINGS

FIG. 10 is a cross-sectional view similar to that of FIG. 5 showing a connector poised for receipt;

DETAILED DESCRIPTION OF THE PREFERRED EMBODIMENT

Figures 1, 2:
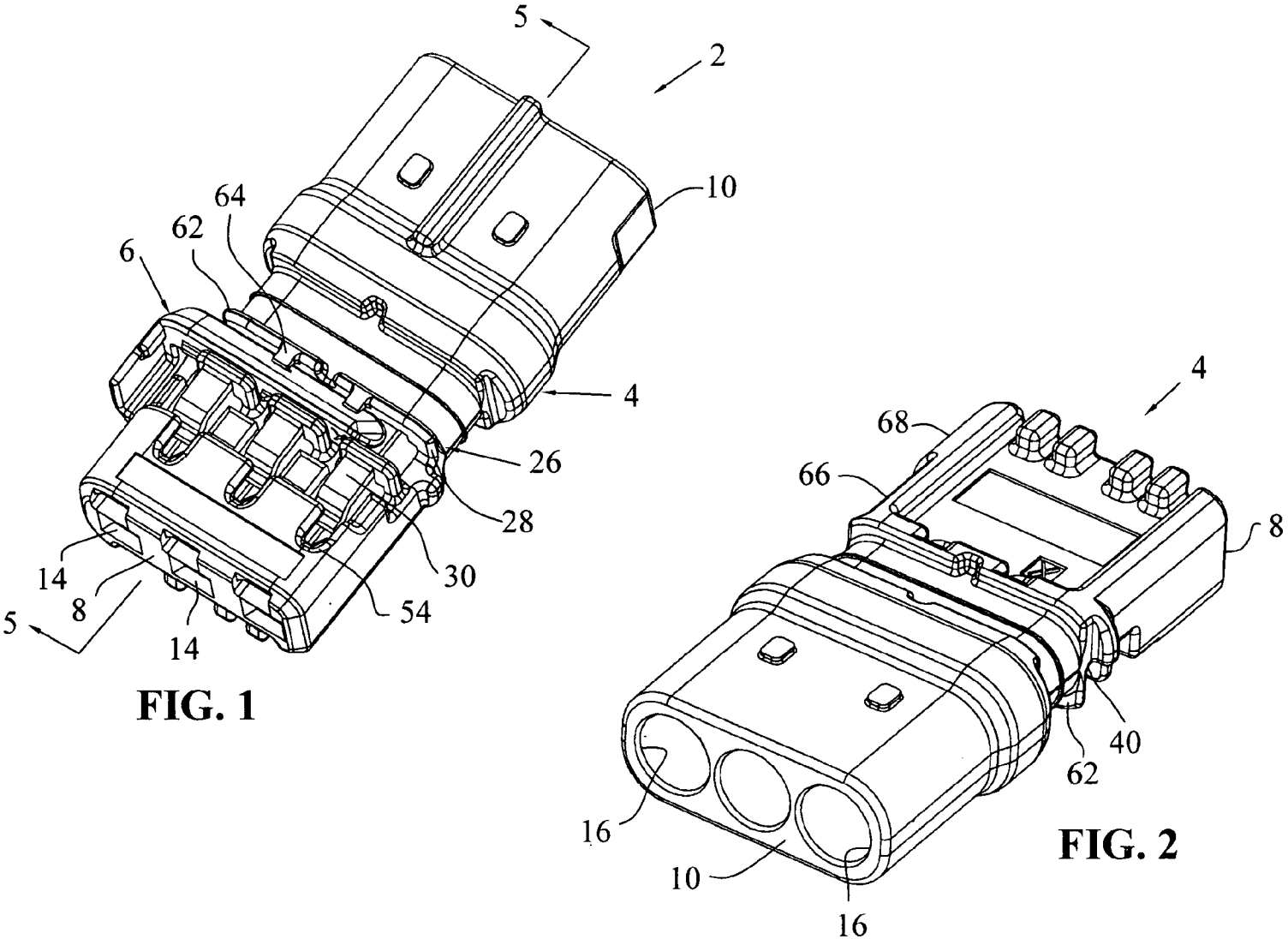
FIG. 1 is a perspective view of the electrical connector of the present invention showing the secondary lock member in the open position.
FIG. 2 shows the housing of FIG. 1 from the opposite side and from the opposite end.

With respect first to FIG. 1, the electrical connector of the present invention is shown at 2, which generally includes an insulative housing 4 and a secondary lock/terminal positioning assurance (TPA) member at 6. As shown in FIG. 1, the secondary lock member 6 is shown in the fully open position, which allows loading of the terminals as is generally known in the art. As is also well known in the art, electrical connector 2 includes a front end or mating end at 8 and includes a terminal receiving or wire receiving end at 10. While many applications exist for the connector shown in FIG. 2, one of the more predominant applications for such a connector would be in the automotive application for such interconnections as sensors, etc.

With respect now to FIGS. 2, 3 and 5, the housing 4 will be described in greater detail. With respect first to FIG. 5, housing 4 includes openings 14 for receiving a pin or terminal blade of a mating connector, while the wire receiving end 10 includes a plurality of openings at 16 (FIG. 2) for receiving the terminal. Receiving openings 16 may be configured to receive only the terminal or, as is shown in FIG. 2, can be profiled to receive a discrete seal about the wire. With respect now to FIG. 5, openings 14 and 16 are interconnected by a terminal receiving passageway at 20, which extends the longitudinal length of the connector housing 4.

Figure 3:
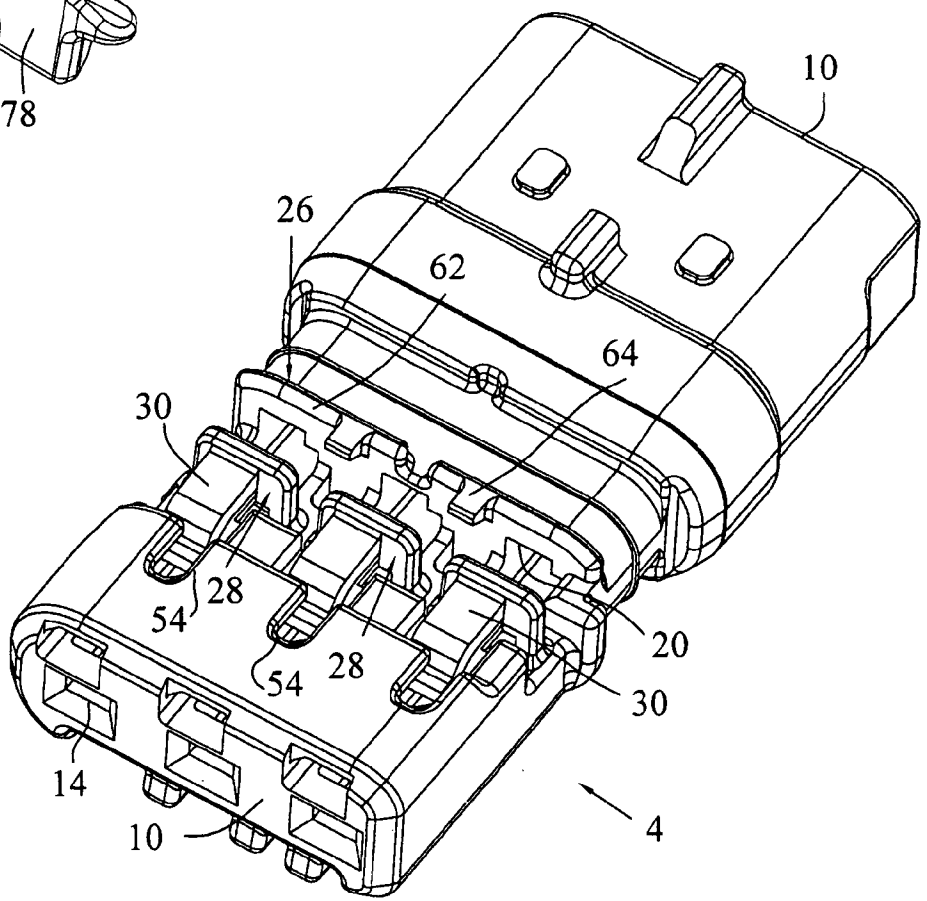
FIG. 3 shows a perspective view of the housing of FIG. 1 with the secondary lock member removed.
Figure 5:
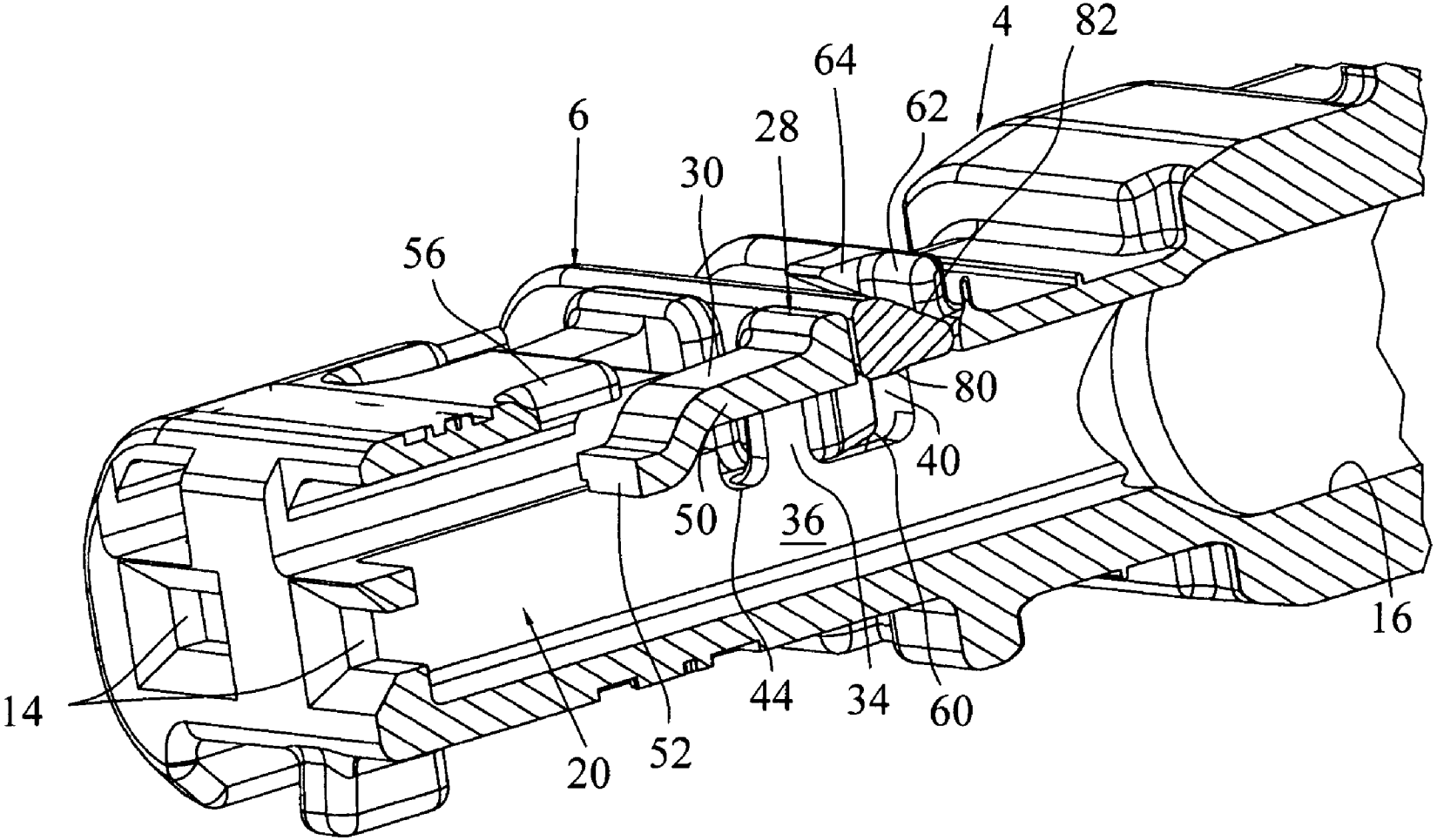
FIG. 5 is a cross-sectional view taken through lines 5—5 of FIG. 1.

As shown best in FIGS. 3 and 5, housing 4 generally includes latch members 26 equal in number to the number of passageways 20 in the electrical connector. Latch 26 is comprised of an arched-shape member 28, which flanks the opening 20 and a latching arm 30 which projects forwardly from the arched-shaped member 28 and extends into the passageway, as best shown in FIG. 5. As shown best in FIG. 5, arched-shaped member 28 is defined by two posts 34 which upstand from side walls 36 of passageway 20 (only one post and one side wall 36 are viewed in FIG. 5 due to the cross-sectional view). Posts 34, on the other hand, are defined by a slot 40, which extends transversely of the housing and runs directly behind posts 34. Post 34 is further defined by an opening at 44, which is forward of posts 34, yet may or may not form a slot, as will be further evident herein.

As is best shown in FIG. 5, latch arm 30 is defined by a forwardly extending arm portion 50, having a downwardly directed foot defining a locking shoulder at 52. As shown best in FIG. 3, housing 4 further includes openings at 54, which are generally aligned with passageways 20 for access to both latch member 30 as well as a terminal positioned therein. The openings further include a tab portion 56, as best shown in FIG. 5. As shown in the embodiment of FIGS. 3 and 5, the tab is defined by an overlapping portion of opening 54 on the left-hand side of latch 30, as viewed therein. This provides an anti-over-stress feature for latch arm 30 to prevent overextending and plastically deforming the latch arm 30.

Finally, with respect to FIGS. 3 and 5, slot 40 will be described in greater detail. Slot 40 defines posts 34 as mentioned above, as well as lower surface 60 of slot 40. A peripheral wall 62 (FIG. 3) is positioned directly behind slot 40, which helps to define the slot as well as includes keepers 64 which provide for guiding and keeping the secondary latch member 6 in position, as will be described further herein. Finally, and as best shown in FIG. 2, housing 4 includes an opening 66, which extends through the peripheral outer side wall 68 of housing 4.

Figure 4:
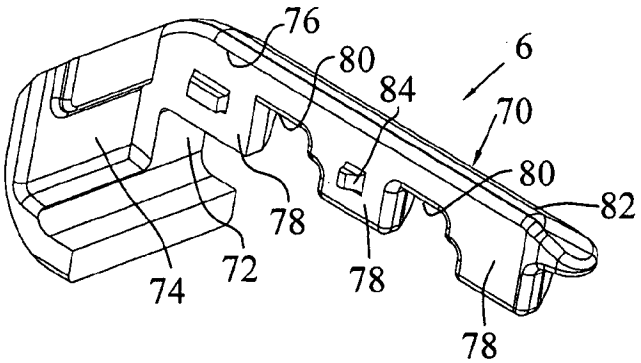
FIG. 4 shows a perspective view of the secondary lock member removed from the housing of FIG. 1.

With respect now to FIG. 4, the secondary lock member 6 will be described in greater detail. As shown in FIG. 4, secondary lock member 6 generally includes a transverse sliding arm 70, a right-angled leg portion at 72, and an extending lateral wall portion at 74. Sliding portion 70 includes a generally perpendicular face at 76, which includes individual locking surfaces at 78, and intermediate opening portions at 80. Secondary lock member further includes an angled surface at 82, and locking detents at 84.

Figure 6:
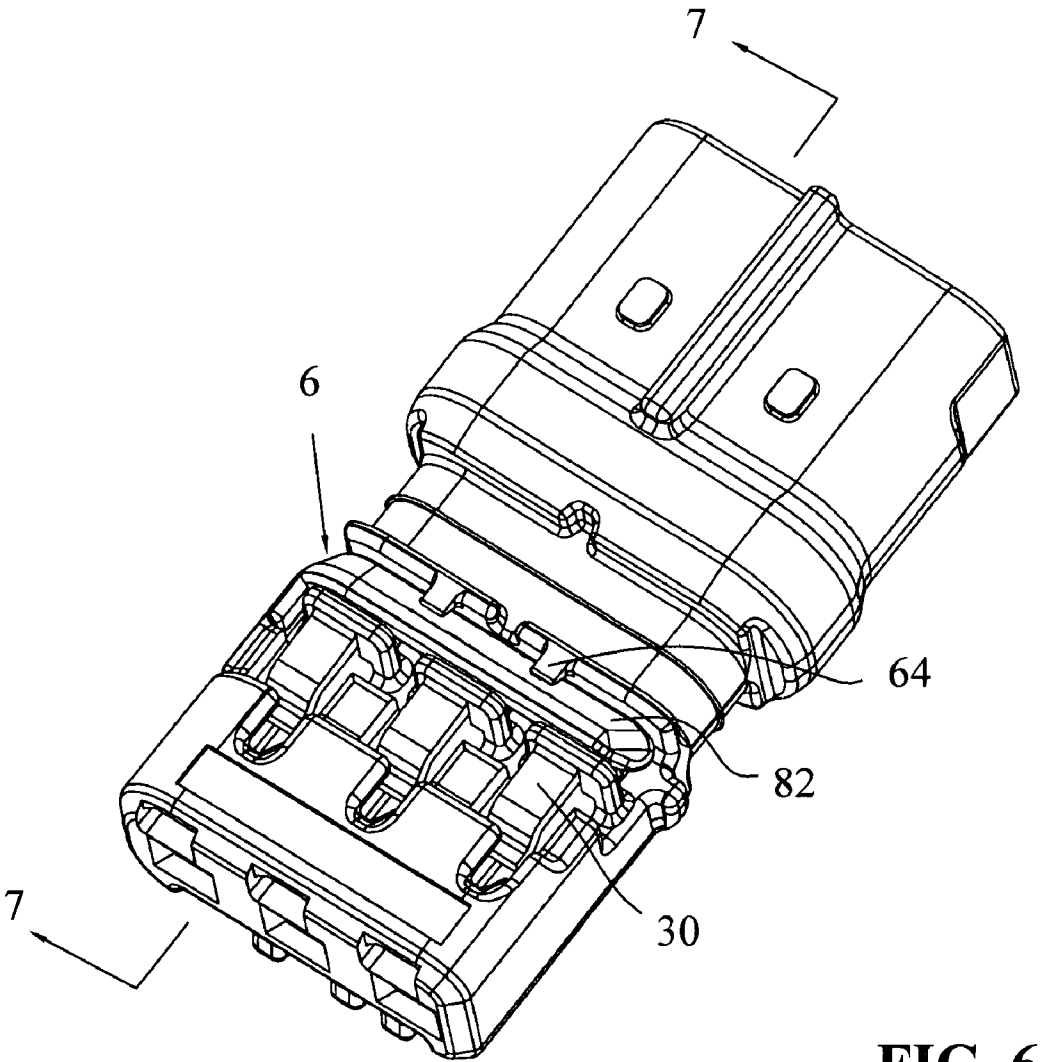
FIG. 6 is a perspective view similar to that of FIG. 1 showing the secondary lock member in the fully locked position.
Figure 7:
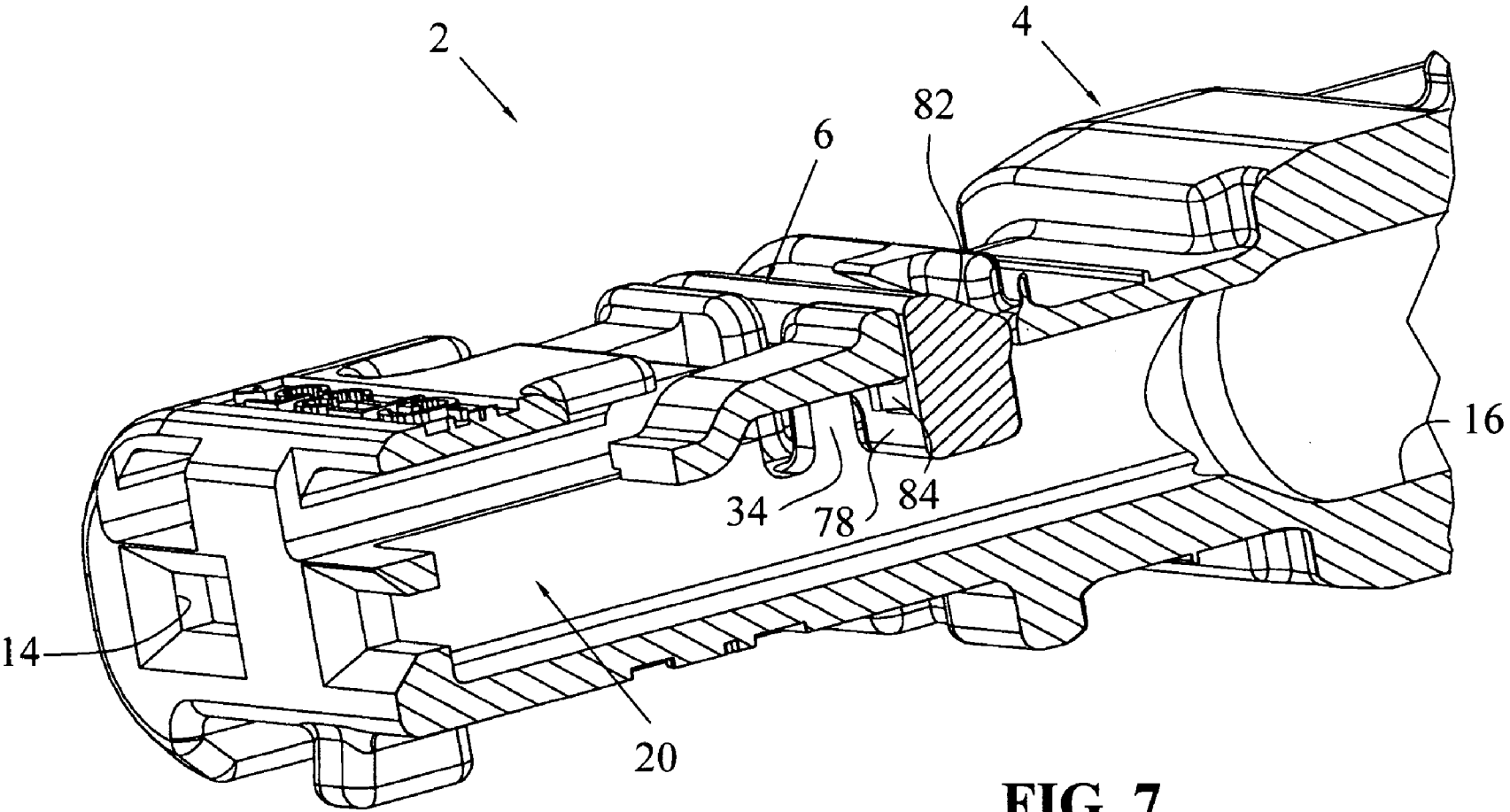
FIG. 7 shows a cross-sectional view taken through lines 7—7 of FIG. 6.

It should be appreciated that sliding arm 70 is profiled to be receivable in slot 40. The secondary lock 6 is movable into slot 40 with the angled surface 82 positioned beneath keepers 64, as best shown in FIG. 5. As shown in FIG. 5, the secondary lock is shown in the open, or terminal insertion position. Openings 80 are shown aligned with passageways 20. The secondary lock is movable to the position shown in FIGS. 6 and 7, where the secondary lock 6 is movable to the position where locking surface 78 is now aligned with passageways 20, as will be described herein. As shown in FIG. 7, detent 84 is also shown in a position beyond post 34 for latching purposes.

Figure 8:
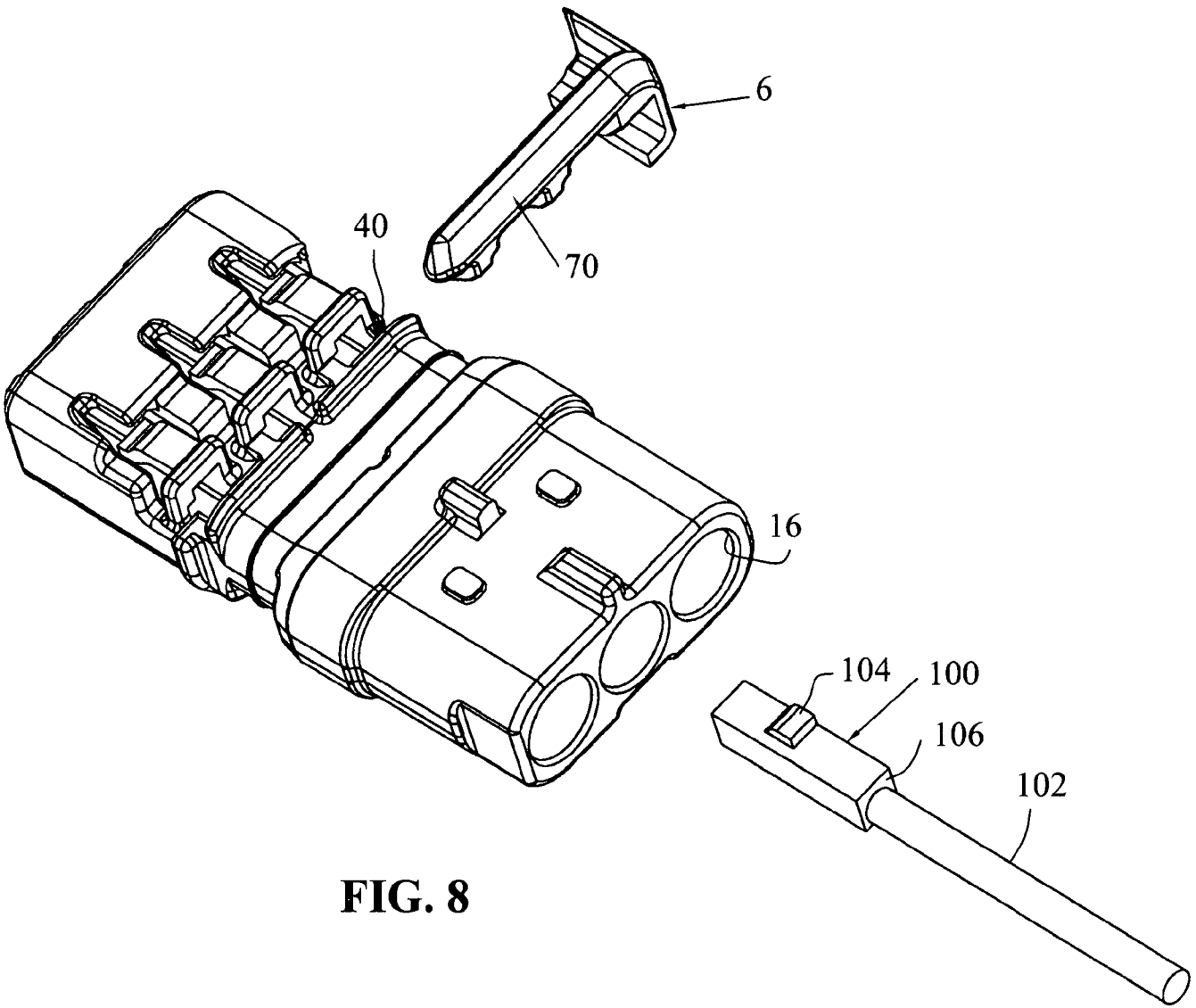
FIG. 8 shows a rear perspective view of the housing poised for receipt of the secondary lock member and a terminal.
Figure 9:
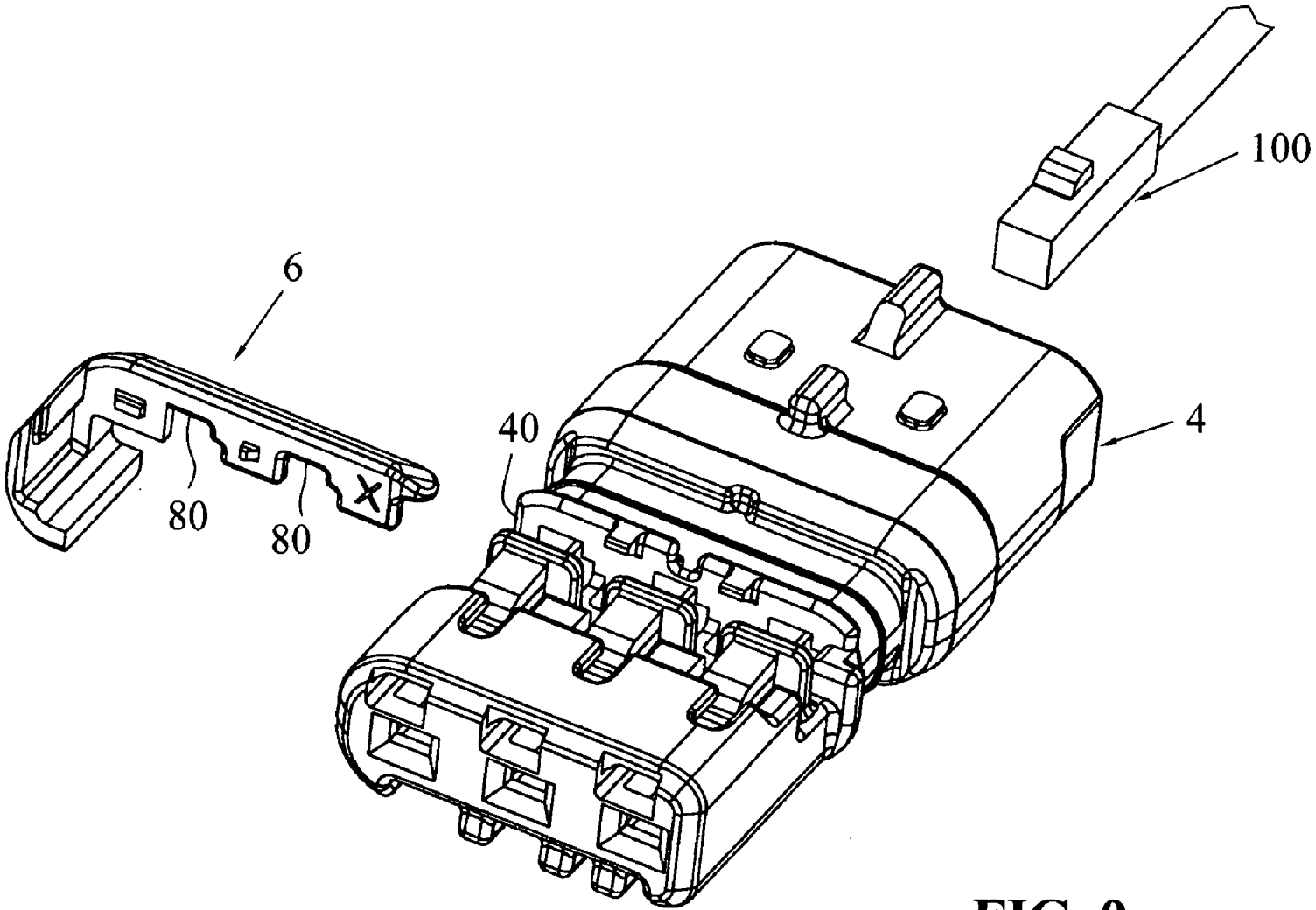
FIG. 9 is a front perspective view of the connector housing poised for receipt of the secondary lock member and a terminal.

With the connector as described above, the application will now be described with reference to FIGS. 8 through 12. As shown in FIGS. 8 and 9, the secondary locking member 6 is shown in a position to be received within the slot 40 into the position shown first with respect to FIG. 5, where openings 80 align with passageways 20 (FIG. 5). It should be appreciated that, when in this position, terminals such as 100 which are crimped to wires 102 can be inserted into receiving passageways such as 16 (FIG. 8) and be moved forwardly into the passageway such that contact 100 is positioned adjacent to front face 10. As shown in FIG. 8, contact 100 is shown somewhat diagrammatically to include a first locking member such as 104 and a locking shoulder such as 106. First locking member 104 could be any means of providing a first shoulder to lock against latch arm 30, which could be a locking lance integrated with the socket body or could simply be a first shoulder on the socket contact. Likewise, locking surface 106 could be the end of a box-shaped section of a terminal, or could be an overlapping backup spring box as is common in electrical terminals.

Figure 11:
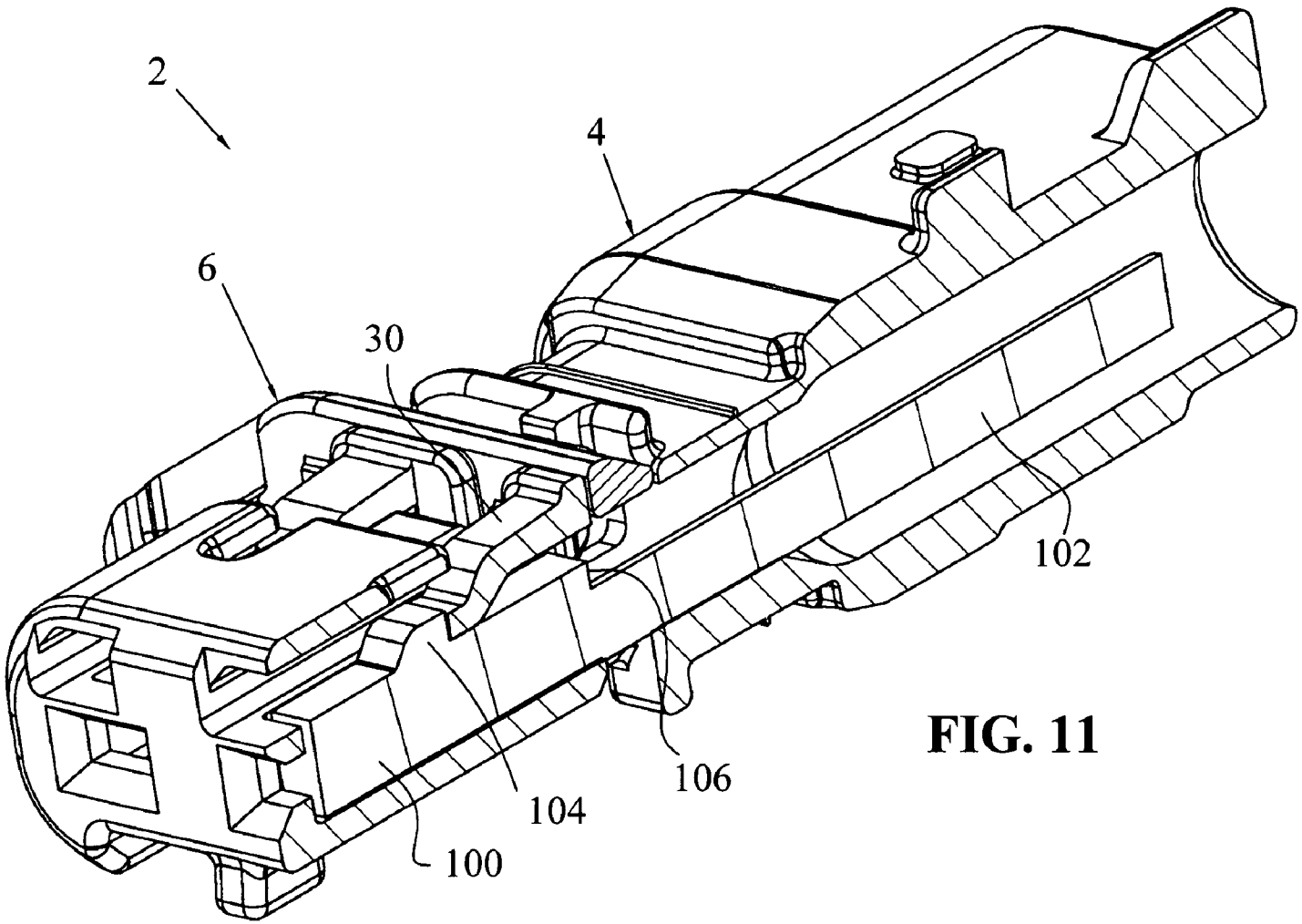
FIG. 11 is a cross-sectional view similar to that of FIG. 10 showing the terminal fully inserted.
Figure 12:
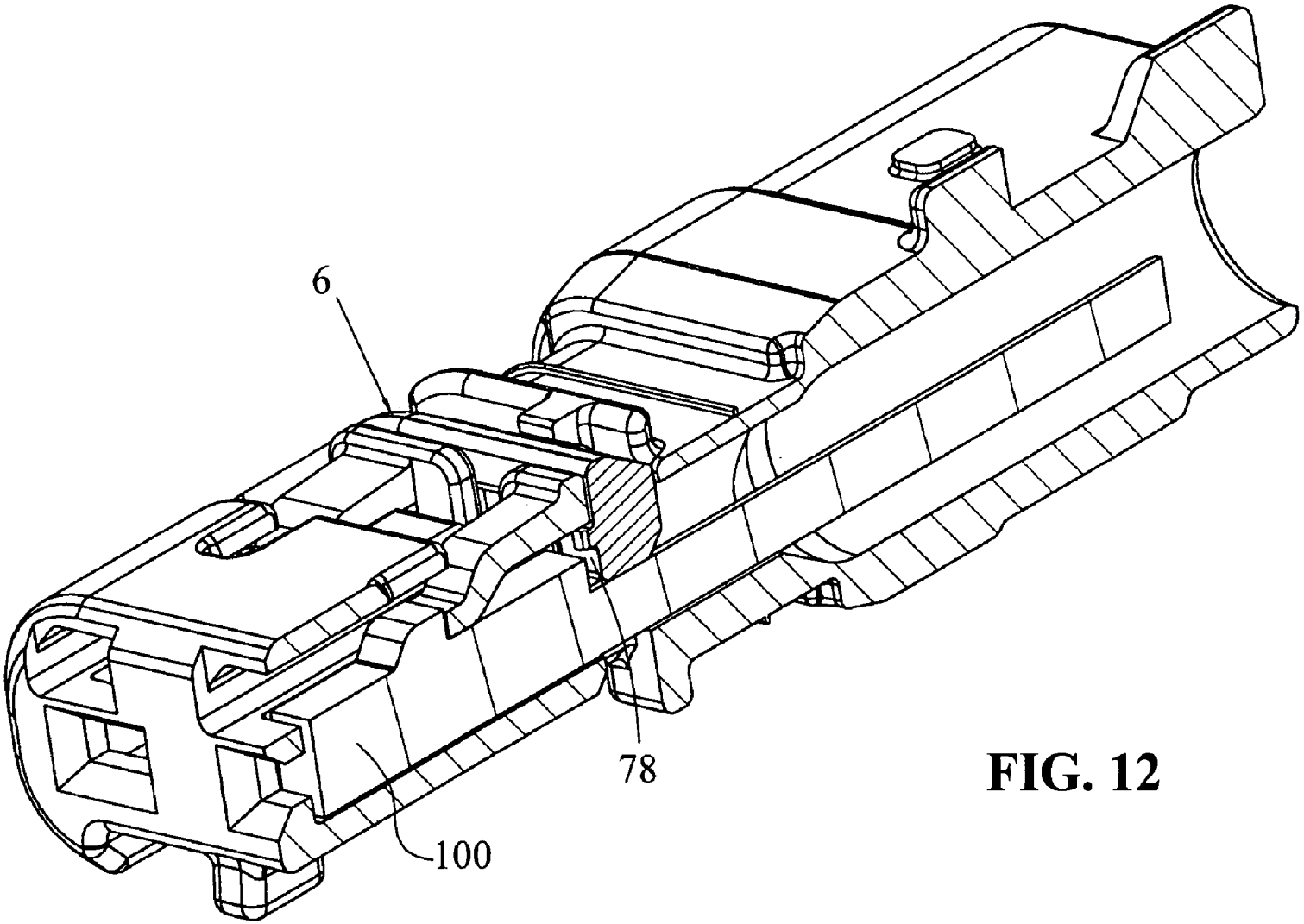
FIG. 12 is a cross-sectional view similar to that of FIG. 11 showing a secondary lock member in its final position.

Regardless of its configuration, contact 100 is moved into passageway 16 from a position shown in FIG. 10 to the position shown in FIG. 11. When in the position shown in FIG. 11, contact 100 is moved into its fully locked position, where latch arm 30 is positioned against locking member 104. This provides for the primary locking of terminal 100 into connector housing 4. As shown in FIG. 11, secondary lock member 6 is still shown in the open position, and when the terminal reaches the position shown in FIG. 11, the secondary lock member 6 is moved into position shown in FIG. 12, where locking surface 78 of secondary lock member 6 is moved behind locking shoulder 106 (FIG. 8) of the contact member 100.

The above-mentioned embodiments show and provide multiple advantages. First, since the latch arms 30 of the connector housing 4 are interconnected to the housing by both the cantilever beam arm 50 as well as by posts before, as best shown in FIG. 5, the latch member 26 is movable in multiple directions during the insertion of a terminal. Said differently, posts 34 are movable in the axial direction, that is, in the direction of the passageway, while at the same time the latch arms 30 which are integrally connected to the arch 28 are movable in a cantilevered fashion, being spring biasable upwardly towards tab member 56. Therefore, due to the fact that the latch arm 30 need not be as long as other latch arms, the overall length of the connector housing can be reduced. Secondly, the secondary lock member 6 provides for easy insertion and locking of the terminals in the passageway and also provides for a backup of the arch member by being positionable in the slot and by being positioned against post 34 such that any rearwardly directed force on face 52 of latch arm 30 (as viewed in FIG. 5), would bear the force on post 34. Finally, openings 54 are provided over the latch arm 30 and provide an anti-overstress tab 56 (FIG. 5) to prevent overstressing latch arms 30.

What is claimed is:

1. An electrical connector comprised of a housing having a terminal receiving passageway therethrough, the passageway including an integrated latch member, the latch member including at least one post member upstanding from a periphery of said passageway and being resilient relative to said housing in a longitudinal direction, and a terminal retaining latch extending from said post, and extending in a resilient manner therefrom.

2. The connector of claim 1, wherein said integrated latch member includes two upstanding posts from said passageway in an arch-shaped manner, with the latch member extending forwardly therefrom.

3. The connector of claim 2, wherein said housing include an opening through said passageway over said terminal retaining latch for access thereto.

4. The connector of claim 3, further comprising an overstress tab, adjacent said opening, and extending over a top of said terminal retaining latch.

5. The connector of claim 1, wherein said connector comprises a plurality of passageways, and said posts are defined by a slot extending behind said posts.

6. The connector of claim 5, further comprising a secondary lock member slidably received in said slot, said secondary lock member having openings and lock members, and said secondary latch being movable from a first position where said openings are aligned with said passageways and allows a terminal to be inserted therein, to a second position where said lock members of said secondary lock move to a position behind a contact in said passageway to secondarily lock the terminal in place.

7. The connector of claim 6, wherein the secondary lock member is profiled to closely approximate the slot and backs up the post.

8. An electrical connector comprised of a housing having a longitudinally extending terminal receiving passageway therethrough, and an integrated latch member extending at least partially into the terminal receiving passageway and being resiliently deformable in a plurality of directions upon the insertion of a terminal into said terminal receiving passageway, where at least one of said directions is longitudinal.

9. The connector of claim 8, wherein the latch member is in the form of an arch member flanking said passageway and having a latch arm extending integrally therefrom and extending into the passageway.

10. The electrical connector of claim 9, wherein arch is partially defined by a slot extending behind, and transversely of, said passageways.

11. The electrical connector of claim 10, wherein said latch arm extends forwardly from said arch.

12. The electrical connector of claim 10, wherein said latch is connected to said housing by only said arch.

13. The electrical connector of claim 9, wherein said arch member is resiliently movable in the longitudinal direction, and the latch arm depends from said arch member in a resiliently cantilevered manner.

14. The connector of claim 9, wherein said housing includes an opening through said passageway over said latch arm for access thereto.

15. The connector of claim 14, further comprising an overstress tab, adjacent said opening, and extending over a top of said latch arm.

16. The connector of claim 11, wherein said connector comprises a plurality of passageways.

17. The connector of claim 10, further comprising a secondary lock member slidably received in said slot, said secondary lock member having openings and lock members, and said secondary latch being movable from a first position where said openings are aligned with said passageways and allows a terminal to be inserted therein, to a second position where said lock members of said secondary lock move to a position behind a portion of a contact in said passageway to secondarily lock the terminal in place.

18. The connector of claim 17, wherein the secondary lock member is profiled to closely approximate the slot and backs up the arch.

19. An electrical connector comprised of a housing having a terminal receiving passageway therethrough, the passageway including an integrated latch member having a portion connected to the housing and movably longitudinally thereto and a latch arm extending therefrom, and a slot extending rearwardly of said integrated latch portions, and having a slidable member receivable in said slot to back up said integrated latch members.

20. The connector of claim 19, wherein said integrated latch member includes two upstanding posts extending upwardly from said passageway in an arch-shaped manner, with the latch member extending integrally and forwardly therefrom.

21. The connector of claim 20, wherein said housing includes an opening through said passageway over said integrated latch member for access thereto.

22. The connector of claim 21, further comprising an overstress tab, adjacent said opening, and extending over a top of said latch member.

23. The connector of claim 22, wherein the slidable member is defined as a secondary lock member slidably received in said slot, said secondary lock member having openings and lock members, and said secondary latch being movable from a first position where said openings are aligned with said passageways and allows a terminal to be inserted therein, to a second position where said lock members of said secondary lock move to a position behind a contact in said passageway to secondarily lock the terminal in place.

24. An electrical connector comprised of a housing having a plurality of terminal receiving passageways therethrough, the passageway each including an integrated latch member, the latch member including at least one post member upstanding from a periphery of said passageway, and a terminal retaining latch extending from said post, and extending in a resilient manner therefrom, and said posts being defined by a slot extending behind said posts.

* * * * *